US007063468B2

(12) United States Patent
Youn et al.

(10) Patent No.: US 7,063,468 B2
(45) Date of Patent: Jun. 20, 2006

(54) INK-JET PRINTER HAVING HEAD GAP ADJUSTING APPARATUS

(75) Inventors: Karp-sik Youn, Gyeonggi-do (KR); Jin-ho Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/795,984

(22) Filed: Mar. 10, 2004

(65) Prior Publication Data

US 2004/0189726 A1 Sep. 30, 2004

(30) Foreign Application Priority Data

Mar. 26, 2003 (KR) ..... 10-2003-0018770

(51) Int. Cl.
*B41J 11/20* (2006.01)

(52) U.S. Cl. ..... 400/59; 400/55; 400/56; 400/58; 347/8; 347/14

(58) Field of Classification Search ..... 400/55, 400/56, 58, 59, 354; 347/8, 14, 19, 104, 347/105

See application file for complete search history.

(56) References Cited

U.S. PATENT DOCUMENTS

| | | | | |
|---|---|---|---|---|
| 5,051,008 | A * | 9/1991 | Honda et al. | 400/59 |
| 5,751,301 | A * | 5/1998 | Saikawa et al. | 347/8 |
| 6,604,801 | B1 * | 8/2003 | Park | 347/8 |
| 6,702,693 | B1 * | 3/2004 | Bamber | 473/349 |
| 6,736,557 | B1 * | 5/2004 | DeVore et al. | 400/59 |
| 2003/0107610 | A1 * | 6/2003 | Lim | 347/8 |
| 2004/0258443 | A1 * | 12/2004 | Takeshita et al. | 400/58 |

FOREIGN PATENT DOCUMENTS

JP 07-009729 1/1995

* cited by examiner

*Primary Examiner*—Andrew H. Hirshfeld
*Assistant Examiner*—Marissa Ferguson
(74) *Attorney, Agent, or Firm*—Roylance, Abrams, Berdo & Goodman, L.L.P.

(57) ABSTRACT

Provided is an ink-jet printer comprising a carriage, which is rotatably installed on a guide shaft and includes a stacking portion on which an ink cartridge is stacked, and a balancing portion installed on a side opposite to the stacking portion, so as to move in a straight reciprocating motion along the guide shaft; and a head gap adjusting apparatus, which is rotatably installed in the balancing portion and adjusts a head gap by rotating the carriage centering on the guide shaft according to a thickness of a printing medium.

16 Claims, 12 Drawing Sheets

INK-JET PRINTER HAVING HEAD GAP ADJUSTING APPARATUS

BACKGROUND OF THE INVENTION

This application claims the benefit under 35 U.S.C. §119 (a) of Korean Patent Application No. 2003-18770, filed on Mar. 26, 2003, in the Korean Intellectual Property Office, the disclosure of which is incorporated herein by reference in its entirety.

1. Field of the Invention

The present invention relates to an ink-jet printer. More particularly, the present invention relates to an ink-jet printer having a head gap adjusting apparatus which adjusts a distance between a printing medium and a nozzle according to the thickness of the printing medium.

2. Description of the Related Art

In general, ink-jet printers print an image by ejecting ink onto a printing medium. Specifically, ink-jet printers print a desired image on the printing medium by ejecting ink through nozzles of an ink cartridge which stores ink, while moving a carriage which holds the ink cartridge side to side. The ink cartridge typically includes a printhead that provides a plurality of nozzles through which ink is ejected downwardly.

A space (hereinafter, referred to as a head gap) between the printhead and the printing medium should be maintained at a constant level, so as to optimize printing quality. In other words, the smaller the head gap is, the larger the printed pixels are, and the larger the head gap is, the smaller the printed pixels are. As such, when the head gap is too large the shape of each pixel is deformed, and the quality of a recorded image is lowered.

Printing quality can also be deteriorated if the head gap is too small. In particular, if the head gap is not maintained in an optimum state, undried ink on the printing medium can be transferred back to the printhead. When the carriage in which the printhead is received moves in a reciprocating motion perpendicular to a printing medium ejecting direction, the printhead can contact undried ejected ink and smear the ink on the printing medium.

An apparatus for adjusting a head gap according to the thickness of a printing medium to be used therein is disclosed in U.S. Pat. No. 5,751,301.

In the above-disclosed apparatus for adjusting the head gap, a carriage is rotated on a guide shaft such that a space between a printhead and the printing medium is adjusted according to the thickness of the printing medium. However, in the above described apparatus for adjusting the head gap, a user is required to adjust the head gap manually. Thus, there are operational inconveniences, and the head gap cannot be precisely adjusted.

SUMMARY OF THE INVENTION

The present invention provides an ink-jet printer having a head gap adjusting apparatus which adjusts a head gap automatically without the need for a user to manually operate the head gap adjusting apparatus.

According to an aspect of the present invention, an ink-jet printer includes a carriage, which is rotatably installed on a guide shaft and includes a stacking portion on which an ink cartridge is stacked, and a balancing portion installed on a side opposite to the stacking portion, so as to move in a straight reciprocating motion along the guide shaft, and a head gap adjusting apparatus which is rotatably installed in the balancing portion and adjusts a head gap by rotating the carriage centering on the guide shaft according to a thickness of a printing medium.

According to another aspect of the present invention, an ink-jet printer includes a carriage, which is rotatably installed on a guide shaft and includes a stacking portion on which an ink cartridge is stacked, and a balancing portion installed on a side opposite to the stacking portion, so as to move in a straight reciprocating motion along the guide shaft, a head gap adjusting apparatus, which is rotatably installed in the balancing portion and adjusts a head gap by rotating the carriage centering on the guide shaft according to a thickness of a printing medium, and a bracket, which supports both ends of the guide shaft and on which a plurality of stoppers are provided so as to rotate the head gap adjusting apparatus while contacting the head gap adjusting apparatus.

BRIEF DESCRIPTION OF THE DRAWINGS

The above and other aspects and advantages of the present invention will become more apparent by describing in detail preferred embodiments thereof with reference to the attached drawing figures in which.

Throughout the drawing figures, it should be understood that like reference numerals refer to like features and structures.

DETAILED DESCRIPTION OF THE INVENTION

Figure 1:
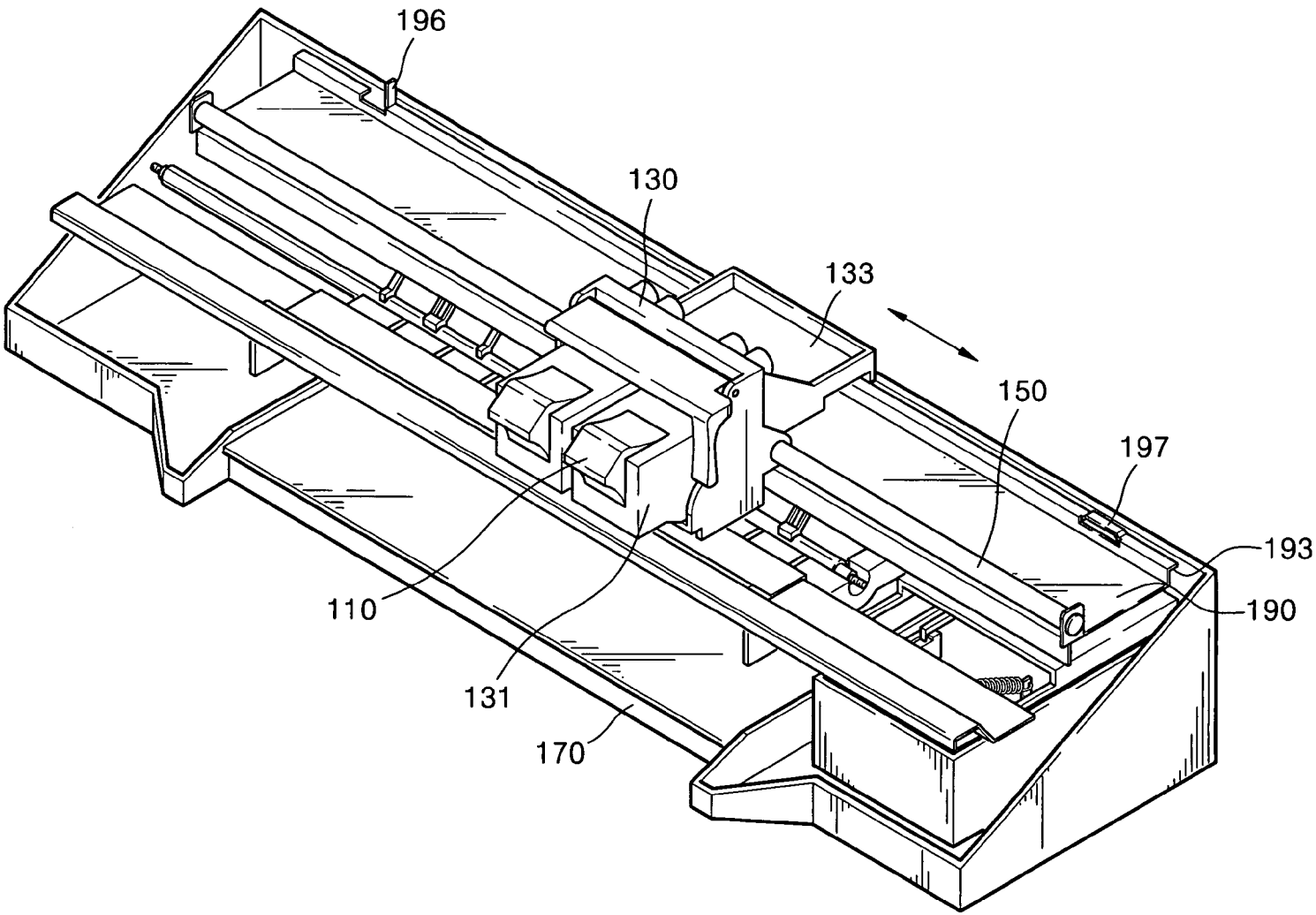
FIG. 1 is a perspective view schematically illustrating the structure of an ink-jet printer having a head gap adjusting apparatus according to an embodiment of the present invention.
Figure 2:
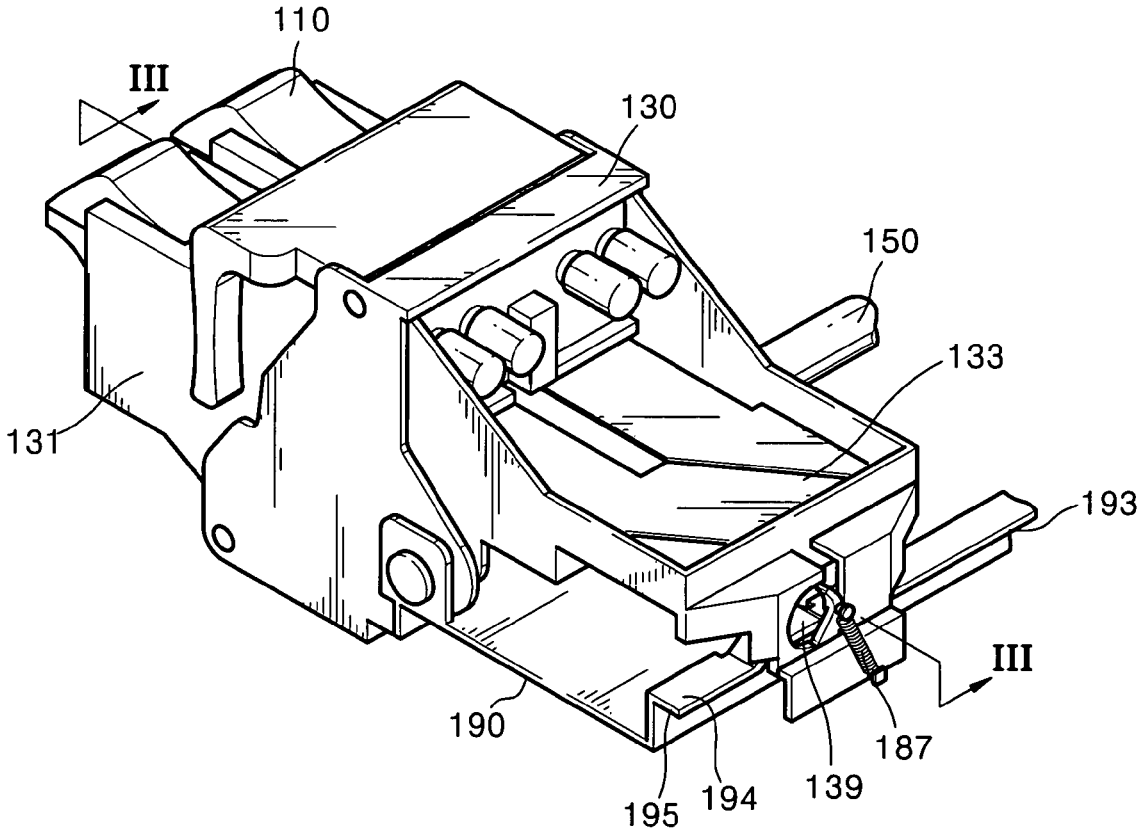
FIG. 2 is a rear perspective view illustrating the structure of the ink-jet printer having the head gap adjusting apparatus according to an embodiment of the present invention.
Figure 3:
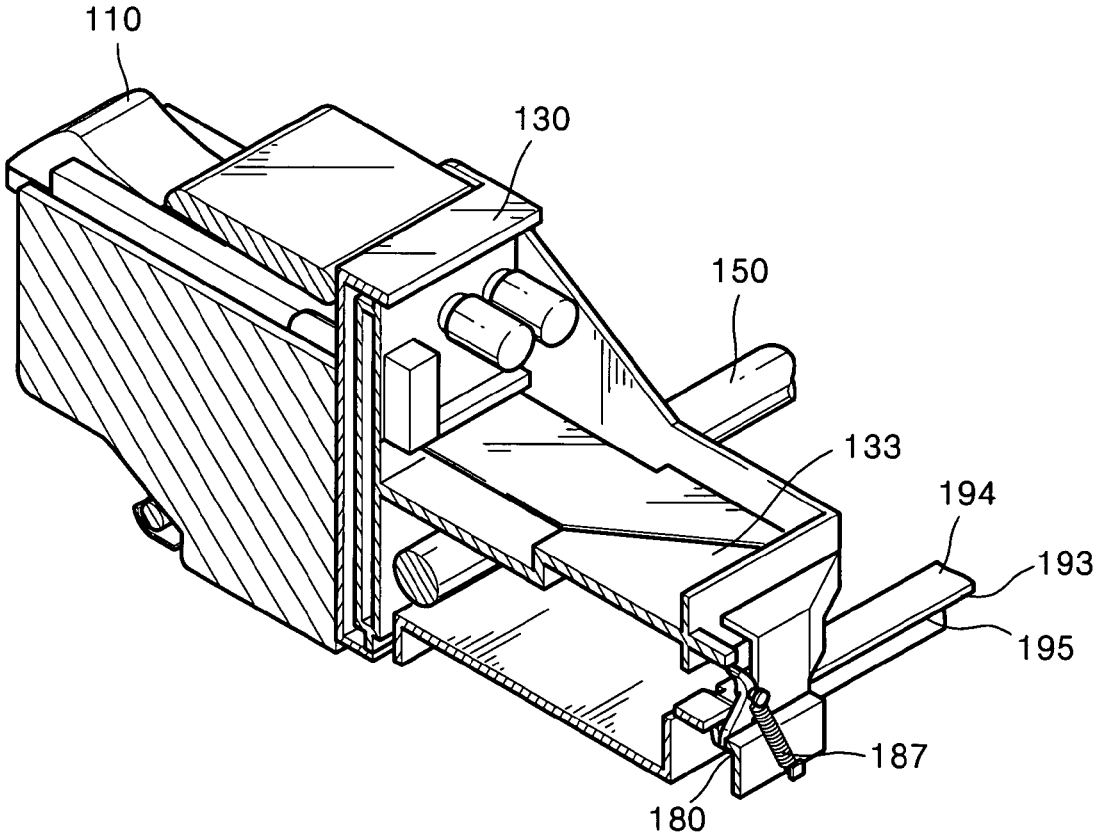
FIG. 3 is a cross-sectional view taken along line III—III of FIG. 2.
Figure 4:
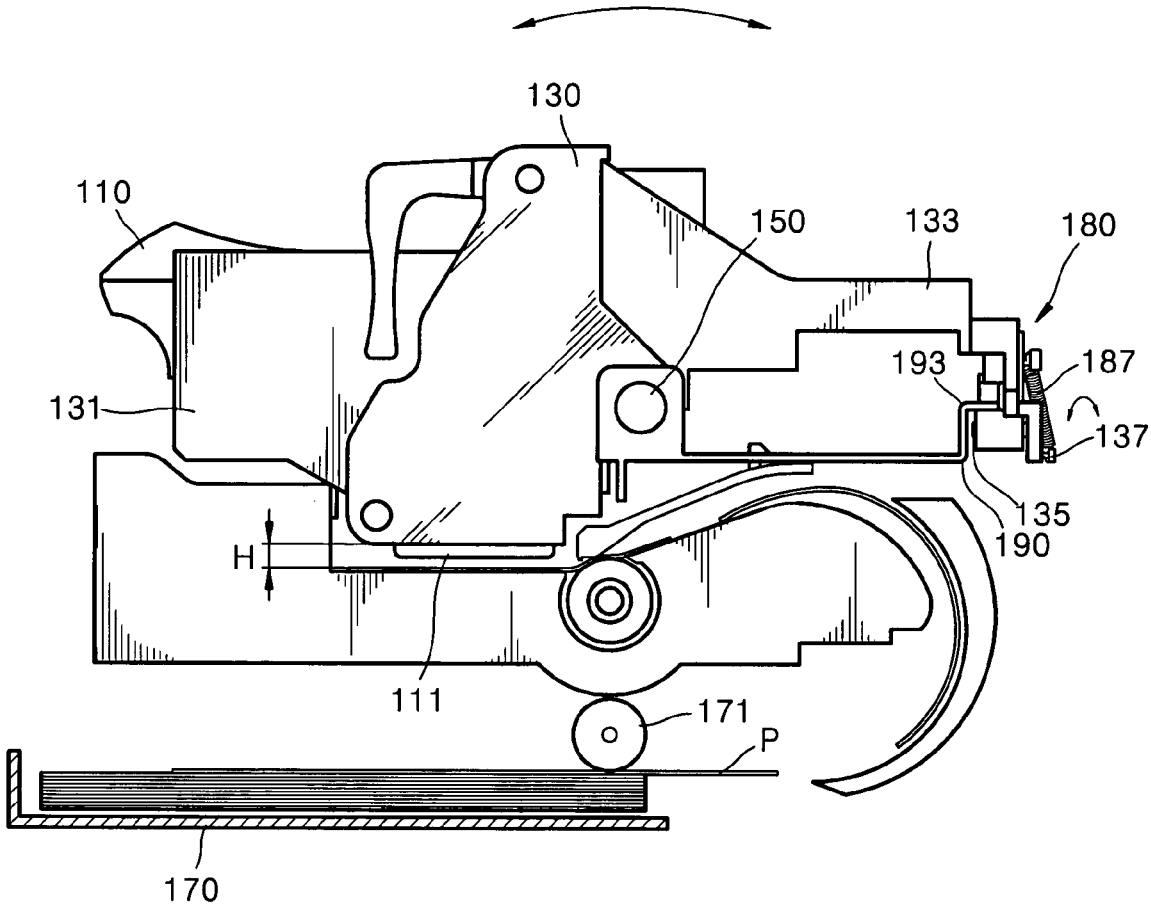
FIG. 4 is a side view schematically illustrating the structure of the ink-jet printer having the head gap adjusting apparatus according to an embodiment of the present invention.
Figure 5:
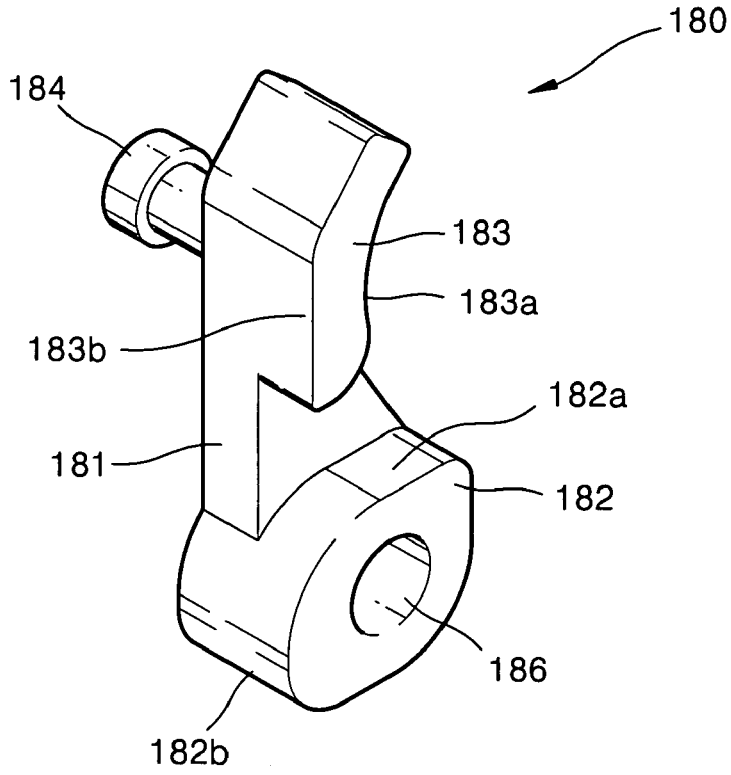
FIG. 5 is a perspective view illustrating one side of the head gap adjusting apparatus according to an embodiment of the present invention.
Figure 6:
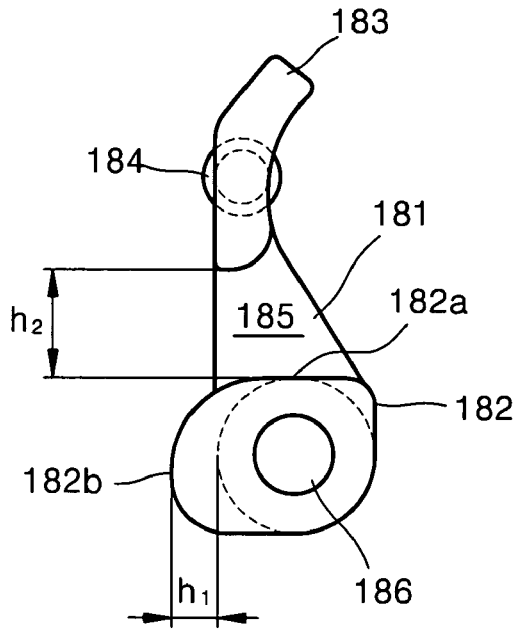
FIG. 6 is a side view illustrating the head gap adjusting apparatus of FIG. 5, according to an embodiment of the present invention.

FIG. 1 is a perspective view schematically illustrating the structure of an ink-jet printer having a head gap adjusting apparatus according to an embodiment of the present invention. FIG. 2 is a rear perspective view illustrating the structure of the ink-jet printer having the head gap adjusting apparatus according to an embodiment of the present invention. FIG. 3 is a cross-sectional view taken along line III—III of FIG. 2. FIG. 4 is a side view schematically illustrating the structure of the ink-jet printer having the head gap adjusting apparatus according to an embodiment of the present invention. FIG. 5 is a perspective view illustrating one side of the head gap adjusting apparatus according to an embodiment of the present invention, and FIG. 6 is a side view illustrating the head gap adjusting apparatus of FIG. 5.

Referring to FIGS. 1 through 4, a carriage 130 is slidably installed on a guide shaft 150. A plurality of ink cartridges 110 storing ink and having a printhead 111 are mounted on the carriage 130. Each printhead 111 has a plurality of nozzles (not shown) facing downwardly through which ink is ejected from the cartridge 110.

The carriage 130 prints a desired image on a printing medium P while being slid to the right and left with respect to FIGS. 1 through 4 along the guide shaft 150 by an additional driving unit (not shown). A paper feeding stand 170 on which the printing medium P is stacked is installed below the carriage 130, and the printing medium P stacked on the paper feeding stand 170 is picked-up by a pickup roller 171 and transferred. The desired image is fused on the printing medium P, which is picked-up by the pickup roller 171, using ink ejected through nozzles (not shown) when passing the printhead 111. The printing medium is then exhausted to outside the ink-jet printer.

The carriage 130 is mounted in the ink-jet printer to be able to rotate around the guide shaft 150, as shown by the arrow in FIG. 4, and moves in a reciprocating motion along the guide shaft 150 in a direction perpendicular to a transferring direction of the printing medium P, as shown in by the arrow in FIG. 1.

The carriage 130 includes a stacking portion 131 on which the plurality of ink cartridges 110 are stacked, and a balancing portion 133 integrally provided on a side opposite to the stacking portion 131.

A head gap adjusting apparatus 180, which adjusts a space H (hereinafter, referred to as a head gap) between the printhead 111 and the printing medium P by rotating the carriage 130 centering on the guide shaft 150, is installed on one side of the balancing portion 133.

The head gap adjusting apparatus 180 is rotatably installed in the balancing portion 133, as shown in FIGS. 5 and 6. The head gap adjusting apparatus 180 includes a body 181, a cam portion 182, which is provided on one end of the body 181 while protruding from the body 181 and in which a cam diagram having a predetermined shape is formed, a guide portion 183, which is provided on the other end of the body 181 while protruding from the body 181 and being bent at a predetermined angle, and a support portion 184, which is provided on a side opposite to a surface in which the guide portion 183 is formed while protruding from the body 181.

An inner surface of the guide portion 183 bent at a predetermined angle is referred to as a first surface 183*a*, and an outer surface thereof is referred to as a second surface 183*b*. The cam portion 182 and the guide portion 183 are provided on the same surface as the body 181 and spaced apart from each other. And a space portion 185 is provided to a predetermined height therebetween.

The cam portion 182 includes a first cam radius 182*a* formed on a surface opposite to the guide portion 183 and a second cam radius 182*b* formed on a surface perpendicular to the first cam radius 182*a*.

Preferably, a curvature radius of the second cam radius 182*b* is larger than that of the first cam radius 182*a* so that a head gap H is changed using a difference $h_1$ in height caused by a difference in curvature radii of the first cam radius 182*a* and the second cam radius 182*b*.

A through hole 186 is formed in the center of the cam portion 182 and extends through the body 181. The through hole 186 is placed around a protrusion part 135 protruding on one end of the balancing portion 133 and is installed to be rotatable. Thus, the head gap adjusting apparatus 180 is rotated centering on the protrusion part 135.

One end of an elastic unit 187 is supported by the support portion 184, and the other end thereof is supported by a fixing part 137 provided on the balancing portion 133.

Both ends of the guide shaft 150 are supported by a bracket 190. A bent portion 193, which is bent to a predetermined height, is provided on one end of the bracket 190. A first stopper 196 and a second stopper 197, which protrude at a predetermined interval, are provided on a top surface 194 of the bent portion 193.

The first stopper 196 is provided on the left side in relation to FIG. 1 and has a straight line shape having a predetermined length in which the top surface 194 of the bent portion 193 is cut and bent upwardly. The first stopper 196 may be separately manufactured and mounted on the top surface 194 of the bent portion 193.

The second stopper 197 is provided on the right side in relation to FIG. 1 and formed in a closed trace shape so as to protrude from the top surface 194 of the bent portion 193. The second stopper 197 may be separately manufactured and mounted on the top surface 194 of the bent portion 193.

A printing section, in which an image is printed on the printing medium P, is placed between the first stopper 196 and the second stopper 197. In other words, the printing medium P passes between the first stopper 196 and the second stopper 197, and the carriage 130 moves in a reciprocating motion and slides, and then, a desired image is printed on the printing medium P.

The first cam radius 182*a* or the second cam radius 182*b* of the cam portion 182 is in contact with a bottom surface 195 of the bent portion 193. Thus, when the carriage 130 slides along the guide shaft 150, the first cam radius 182*a* or the second cam radius 182*b* slides while contacting the bottom surface 195 of the bent portion 193.

Preferably, a height from the top surface 194 of the bent portion 193 of the first stopper 196 is larger than a height $h_2$ of the space portion 185. The first stopper 196 increases the head gap H by rotating the head gap adjusting apparatus 180 while contacting the second surface 183*b* of the guide portion 183 and by having it so that the second cam radius 182*b* is in contact with the bottom surface 195 of the bent portion 193.

On the other hand, preferably, a height from the top surface 194 of the bent portion 193 of the second stopper 197 is smaller than the height $h_2$ of the space portion 185. The second stopper 197 reduces the head gap H by raising the tilted head gap adjusting apparatus 180 rotated by the first stopper 196 and by having it so that the first cam radius 182*a* is in contact with the bottom surface 195 of the bent portion 193.

Accordingly, when the first cam radius 182*a* contacts the bottom surface 195 of the bent portion 193, the head gap H is reduced, and when the second cam radius 182*b* contacts the bottom surface 195 of the bent portion 193, the head gap H is increased.

A hole 139 having a predetermined size which corresponds to a rotation radius of the head gap adjusting apparatus 180, is formed in the balancing portion 133 in which the head gap adjusting apparatus 180 is installed so that rotation of the head gap adjusting apparatus 180 is not disturbed.

Hereinafter, the operation of the head gap adjusting apparatus having the above structure, according to an embodiment of the present invention will be described with reference to the accompanying drawing figures.

Figure 7:
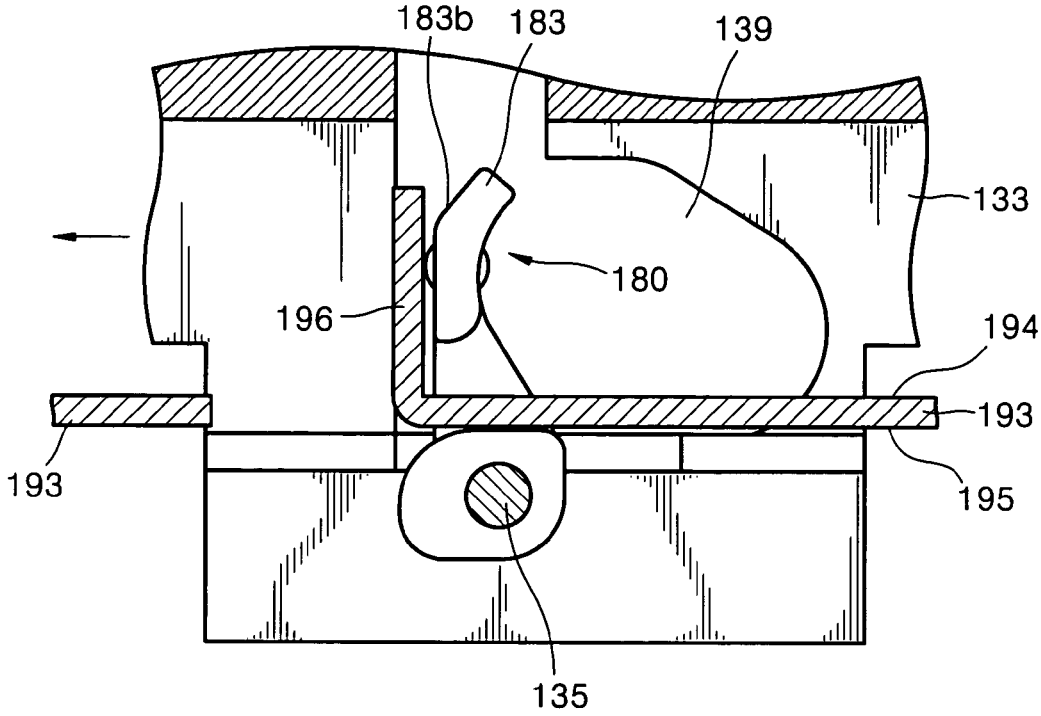
FIGS. 7 through 9 illustrate an operation of the ink-jet printer in which a low head gap is changed into a high head gap, according to an embodiment of the present invention.
Figure 8:
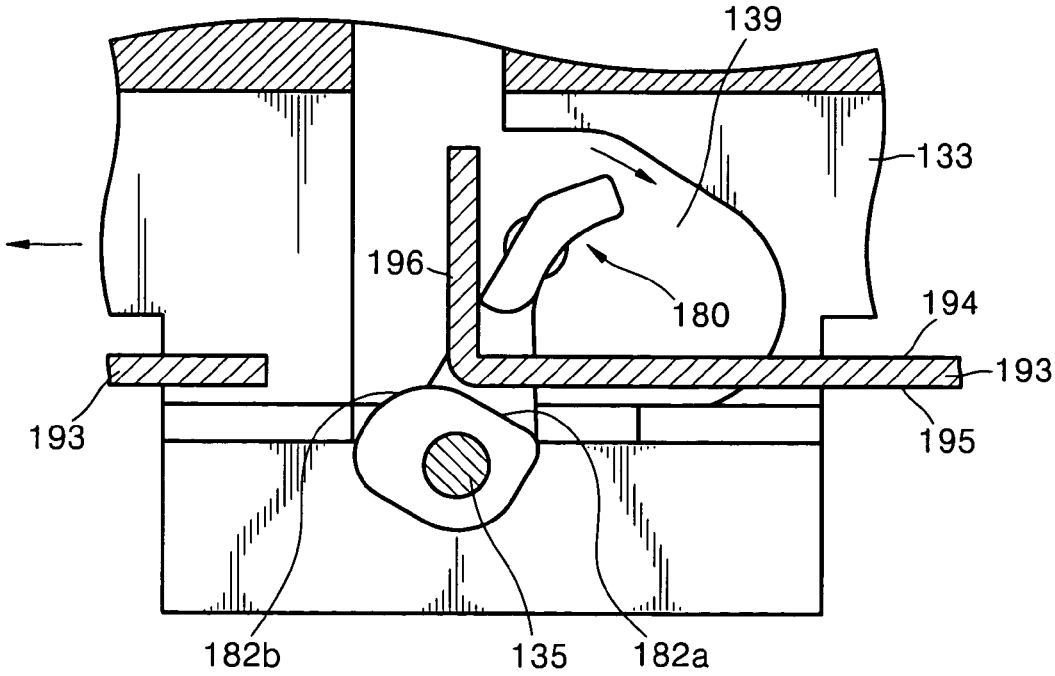
Figure 9:
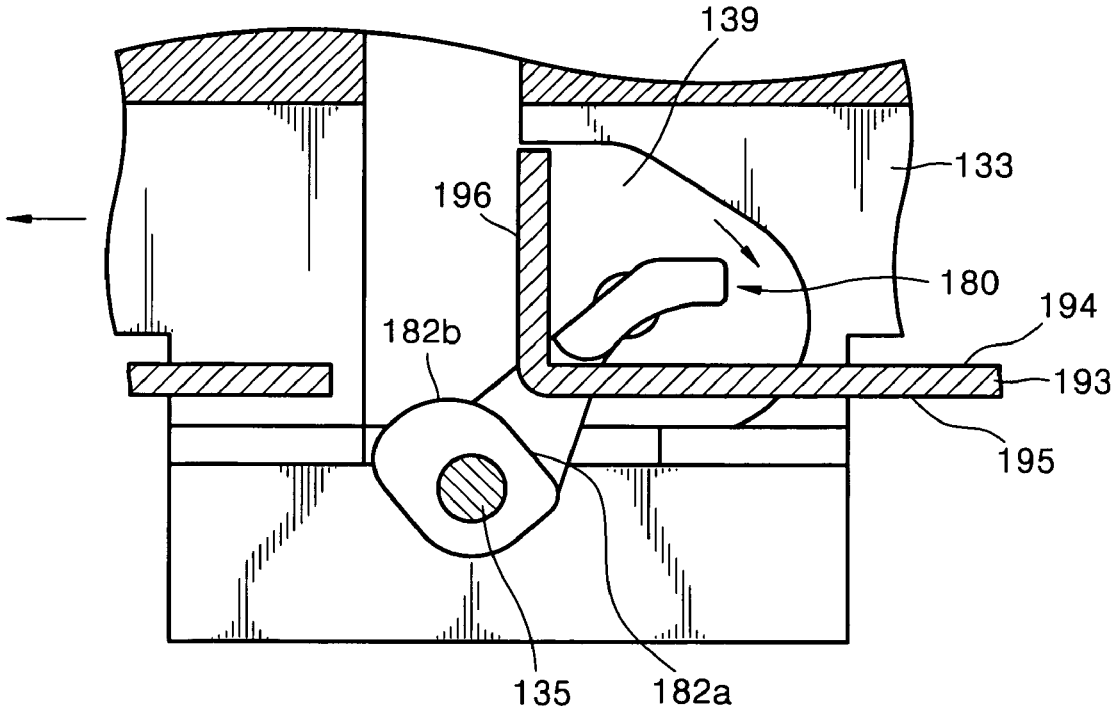
Figure 10:
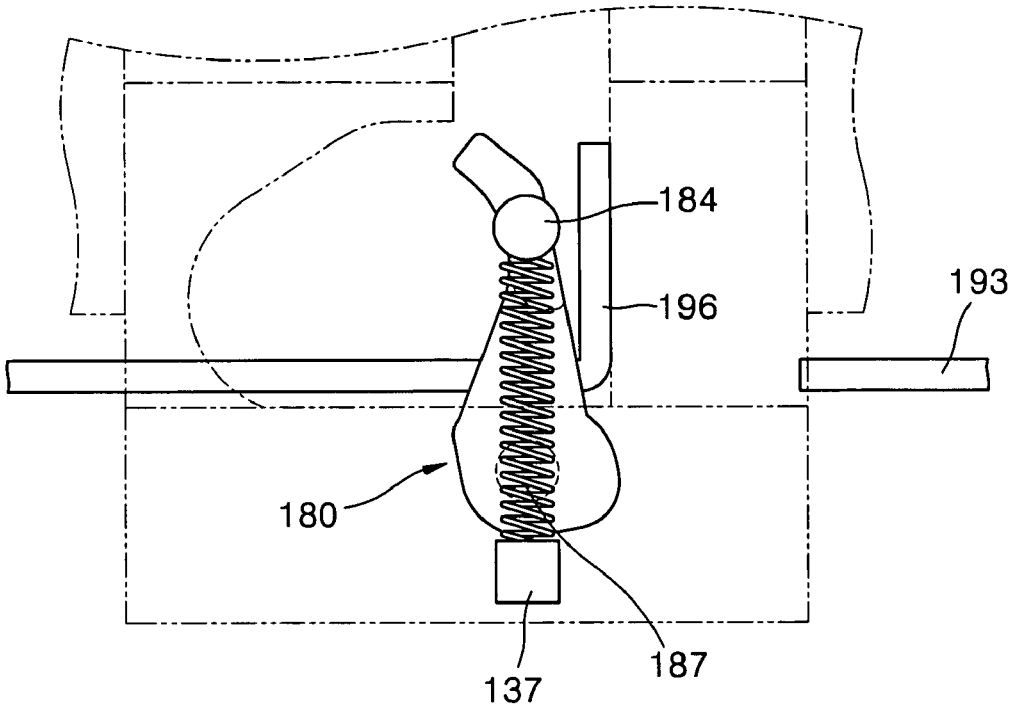
FIGS. 10 and 11 illustrates an operation of an elastic unit when the low head gap of the ink-jet printer is changed into the high head gap thereof, according to an embodiment of the present invention.
Figure 11:
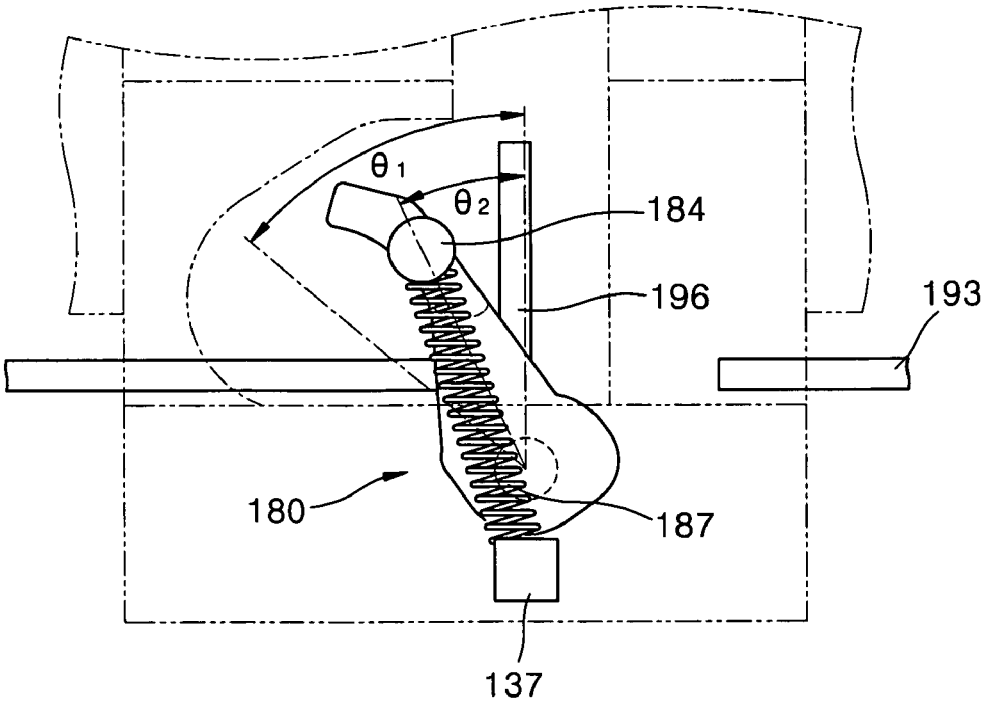
Figure 12:
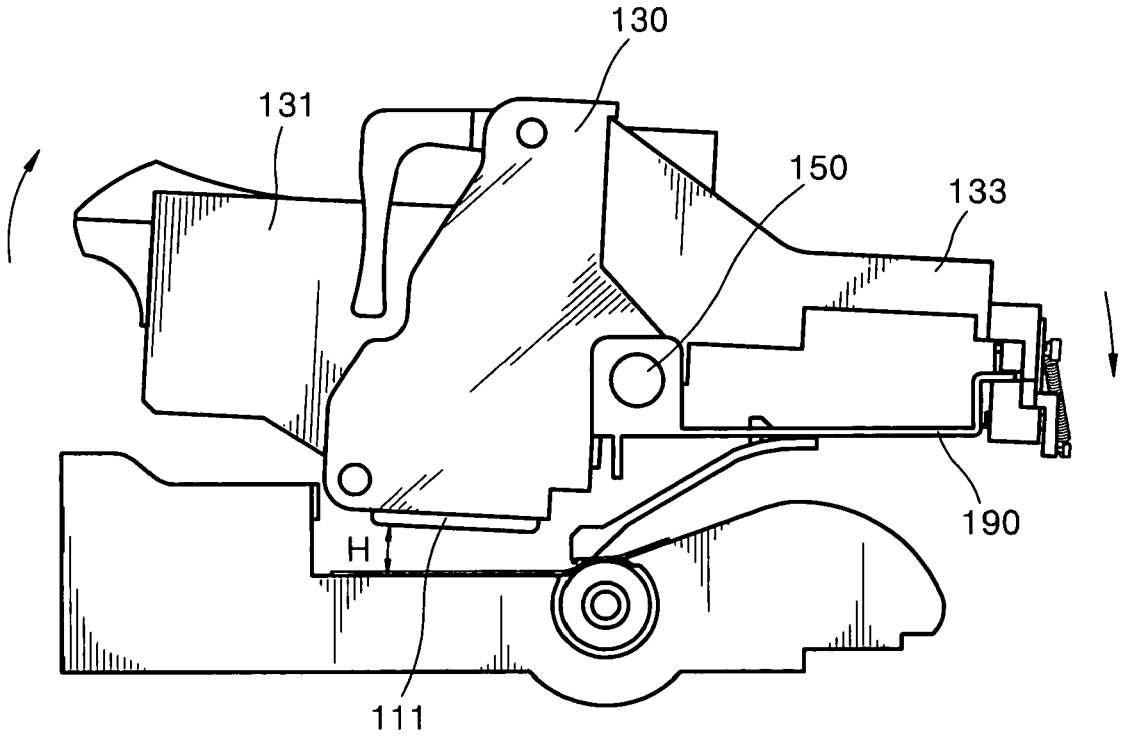
FIG. 12 illustrates a state where a head gap is increased in the head gap adjusting apparatus according to an embodiment of the invention.

FIGS. 7 through 9 illustrate an operation of the ink-jet printer in which a low head gap is changed into a high head gap, according to an embodiment of the present invention. FIGS. 10 and 11 illustrates an operation of an elastic unit when the low head gap of the ink-jet printer is changed into the high head gap thereof, according to an embodiment of the present invention, and FIG. 12 illustrates a state where a head gap is increased in the head gap adjusting apparatus.

A selection mode (not shown) in which the type of the printing medium P to be used can be selected is provided on the paper feeding stand (see 170 of FIG. 4). When the user stacks the printing medium P on the paper feeding stand 170, adjusts the selection mode (not shown), selects the type of the printing medium P and starts a printing operation, a CPU (not shown) transmits a signal to a control unit (not shown) if it is determined that the printing medium P selected by the user is a thick printing medium. The control unit rotates a driving motor (not shown) and moves the carriage 130 to the left side in relation to FIG. 4 along the guide shaft 150.

In this case, before the ink-jet printer starts a printing operation, in general, the printing medium P is in a normal printing medium mode. Thus, the first cam radius 182*a* is in contact with the bottom surface 195 of the bent portion 193.

Referring to FIGS. 7 through 9, while the carriage 130 is moved to the left side in relation to FIG. 1, the second surface 183*b* of the guide portion 183 is in contact with the first stopper 196. FIG. 10 illustrates the operation of the elastic unit 187 when the second surface 183*b* of the guide portion 183 contacts the first stopper 196. In this case, the elastic unit 187 is supported by the supporting portion 184 and the fixing part 137.

The carriage (see 130 of FIG. 3) is further moved to the left side in relation to FIG. 3 by a predetermined distance in a state where the second surface 183*b* of the guide portion 183 is in contact with the first stopper 196. Then, the guide portion 183 is engaged with the first stopper 196. Thus, the head gap adjusting apparatus 180 is rotated centering on the protrusion part 135, clockwise with respect to FIG. 8.

FIG. 10 illustrates the operation of the elastic unit 187 when the guide portion 183 is engaged with the first stopper 196 and the head gap adjusting apparatus 180 is rotated clockwise with respect to FIG. 8.

Referring to FIG. 11, when the carriage (see 130 of FIG. 3) is further moved to the left side in relation to FIG. 3 by a predetermined distance, the head gap adjusting apparatus 180 is rotated counterclockwise by a moving distance of the carriage 130.

When the head gap adjusting apparatus 180 is rotated by $\theta_2$, the head gap adjusting apparatus 180 is rotated by an elastic force of the elastic unit 187 and is in a state shown in FIG. 9.

Referring to FIG. 12, since the curvature radius of the second cam radius 182*b* is larger than that of the first cam radius 182*a*, the balancing portion 133 is rotated downwardly centering on the guide shaft 150 by a height corresponding to a difference in curvature radii. In this case, the stacking portion 131 is rotated in a reverse direction to the rotation direction of the balancing portion 133, i.e., upwardly. Thus, the printhead 111 becomes farther from the printing medium P, and the head gap H is increased.

Meanwhile, when the head gap adjusting apparatus 180 is not elastically biased by the elastic unit 187, the head gap adjusting apparatus 180 should be rotated by over $\theta_1$, as shown in FIG. 11, so that the second cam radius 182*b* comes in contact with the bottom surface 195 of the bent portion 193 and the head gap H is increased.

However, even though the head gap adjusting apparatus 180 is rotated only by $\theta_2$, which corresponds to about half of $\theta_1$, the head gap adjusting apparatus 180 is rotated by the elastic force of the elastic unit 187, and the second cam radius 182*b* comes in contact with the bottom surface 195 of the bent portion 193, and thus, a rotation operation can be performed.

Thus, when the carriage 130 is further moved a predetermined distance, i.e., about 2.5–3 cm, from when the second surface 183*b* of the guide portion 183 is in contact with the first stopper 196, a low head gap is changed into a high head gap by the head gap adjusting apparatus 180.

As described above, in the state where the low head gap is changed into the high head gap, the carriage 130 moves in a straight reciprocating motion in a printing area placed between the first and second stoppers 196 and 197, performs a printing operation, and prints a desired image on the printing medium P.

Figure 13:
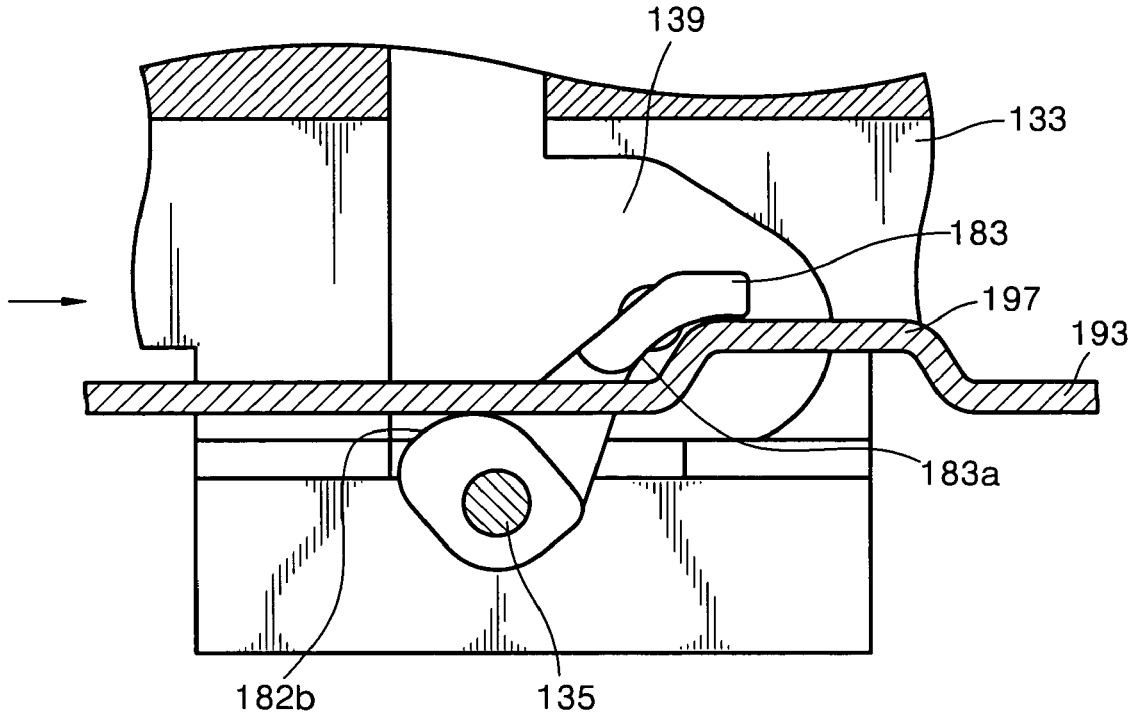
FIGS. 13 through 15 illustrate an operation of the ink-jet printer in which the high head gap is changed into the low head gap, according to an embodiment of the present invention.
Figure 14:
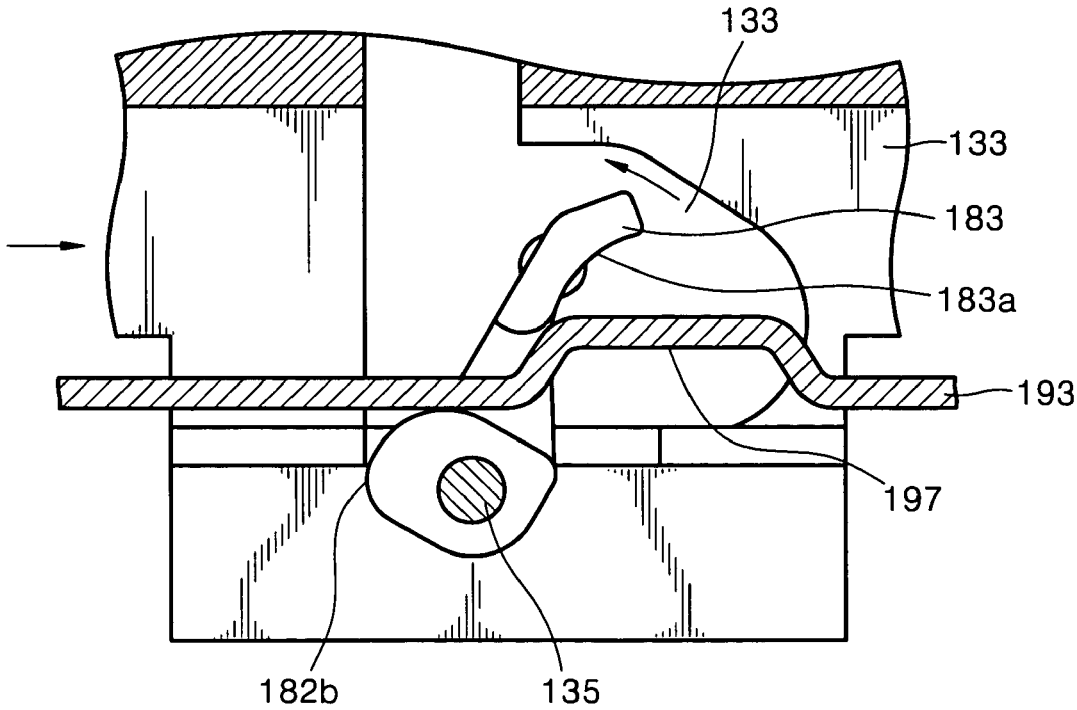
Figure 15:
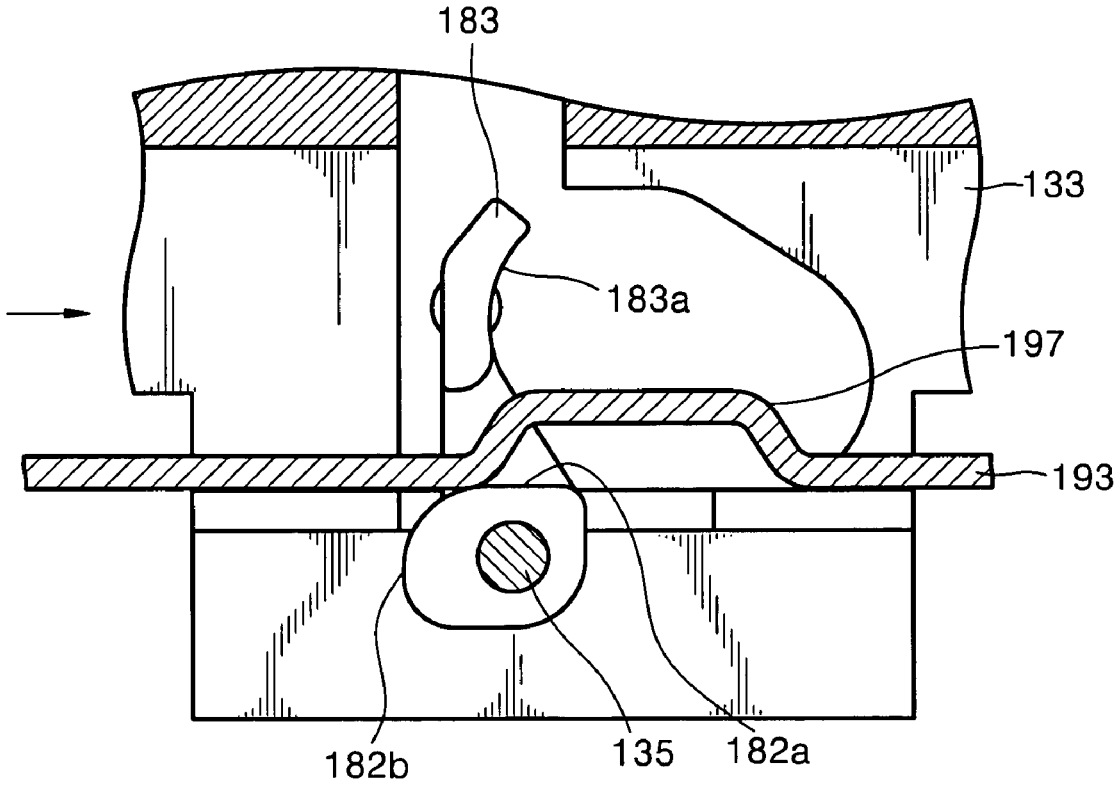
Figure 16:
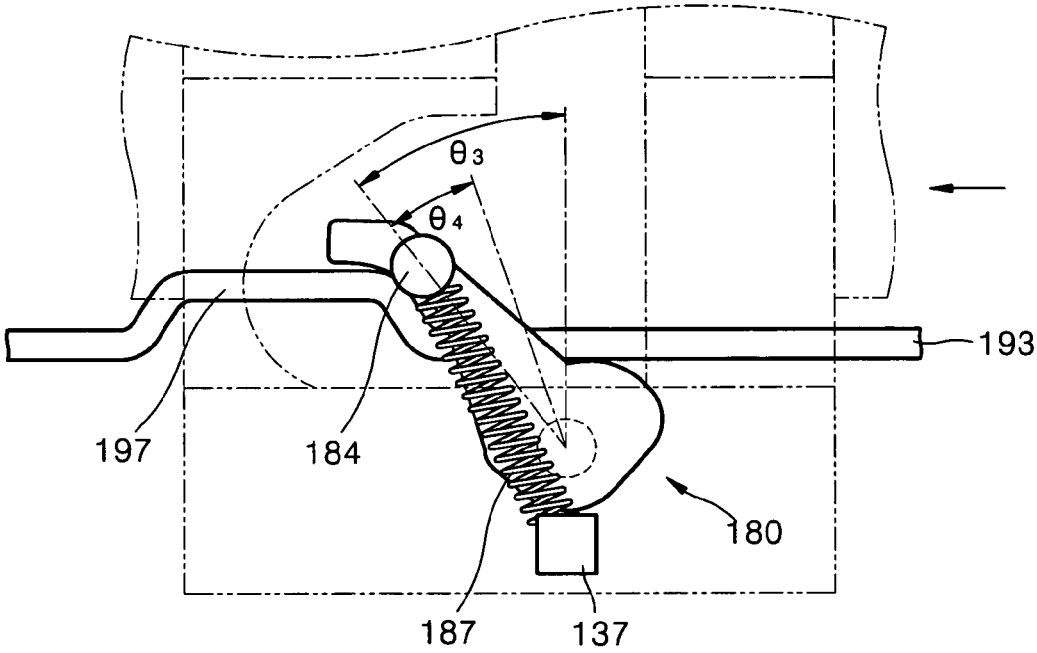
FIGS. 16 and 17 illustrate an operation of the elastic unit when the high head gap of the ink-jet printer is changed into the low head gap thereof according to an embodiment of the present invention.
Figure 17:
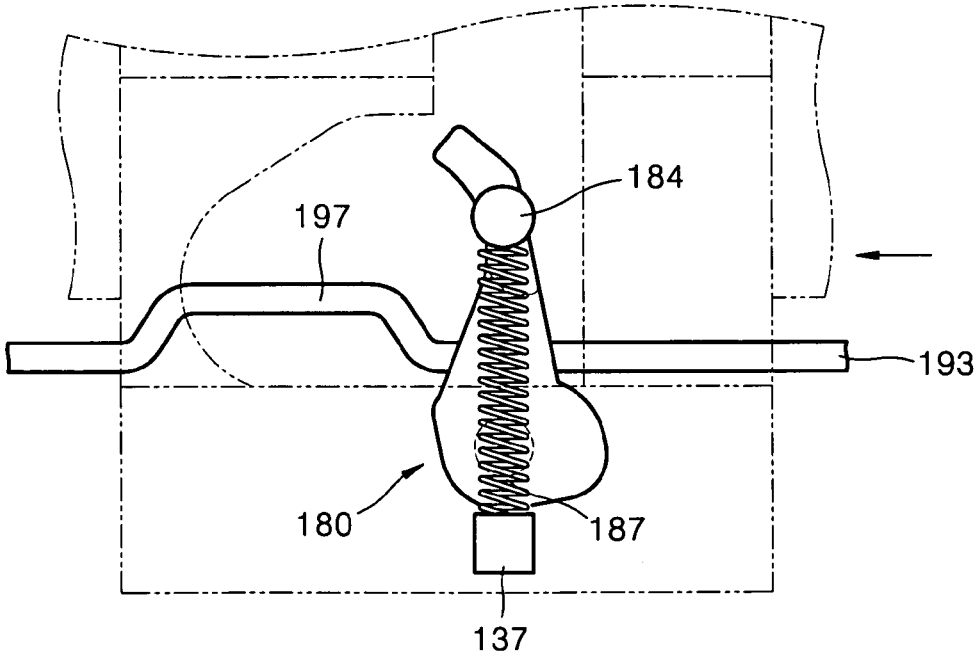

FIGS. 13 through 15 illustrate an operation of the ink-jet printer in which the high head gap is changed into the low head gap, according to an embodiment of the present invention, and FIGS. 16 and 17 illustrate an operation of the elastic unit when the high head gap of the ink-jet printer is changed into the low head gap thereof.

As shown in FIGS. 7 through 9, when the ink-jet printer finishes the printing operation in the state where the low head gap is changed into the high head gap, the control unit (not shown) rotates the driving motor (not shown) and moves the carriage 130 to the right side in relation to FIG. 1 along the guide shaft 150 in a state where the second cam radius 182*a* is in contact with the bottom surface 195 of the bent portion 193. This is because the carriage 130 is in a standby mode after the ink-jet printer finishes the printing operation.

Referring to FIGS. 13 through 15, while the carriage 130 is moved to the right side in relation to FIG. 1, the first surface 183*a* of the guide portion 183 is in contact with the second stopper 197.

FIG. 13 illustrates the operation of the elastic unit 187 when the first surface 183*a* of the guide portion 183 is in contact with the second stopper 197. The elastic unit 187 is supported by the support portion 184 and the fixing part 137.

The carriage (see 130 of FIG. 3) is further moved to the right side in relation to FIG. 1 by a predetermined distance in a state where the first surface 183*a* of the guide portion 183 is in contact with the second stopper 197. Then, the guide portion 183 is engaged with the second stopper 197. Thus, the head gap adjusting apparatus 180 is rotated counterclockwise centering on the protrusion part 135, as shown in FIG. 14.

When the carriage 130 is further moved to the right side in relation to FIG. 1 by a predetermined distance, the head gap adjusting apparatus 180 is rotated counterclockwise by a moving distance of the carriage 130, as shown in FIG. 15.

When the head gap adjusting apparatus 180 is rotated counterclockwise by $\theta_3$, as shown in FIG. 16, the head gap adjusting apparatus 180 is easily rotated by the elastic force of the elastic unit 187.

When the head gap adjusting apparatus 180 is rotated by $\theta_3$ while contacting the second stopper 197, the head gap adjusting apparatus 180 is raised by the elastic force of the elastic unit 187, as shown in FIG. 16. Thus, as shown in FIG. 15, the first cam radius 182*a* is in contact with the bottom surface 195 of the bent portion 193.

Meanwhile, the head gap adjusting apparatus 180 is not elastically biased by the elastic unit 187, the head gap adjusting apparatus 180 should be rotated by more than $\theta_4$, as shown in FIG. 15, so that the first cam radius 182*a* is in contact with the bottom surface 195 of the bent portion 193 and the head gap H is reduced.

As described above, the head gap H is reduced and is in a standby state or the carriage 130 moves in a reciprocating motion between the first and second stoppers 196 and 197, performs a printing operation, and prints a desired image on the printing medium P.

As described above, in the ink-jet printer according to an embodiment of the present invention, a desired head gap can be automatically adjusted without the need for a user to adjust the head gap manually, such that high printing quality can be obtained on a thin printing medium and a smear of ink on a thick printing medium can be prevented.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. An ink-jet printer comprising:

a carriage, which is rotatably installed on a guide shaft and includes a stacking portion on which an ink cartridge is stacked, and a balancing portion installed on a side opposite to the stacking portion, so as to move in a straight reciprocating motion along the guide shaft; and a head gap adjusting apparatus, which is rotatably installed in the balancing portion and adjusts a head gap by rotating the carriage centering on the guide shaft according to a thickness of a printing medium;

wherein the head gap adjusting apparatus comprises:

a body;

a cam portion, which is provided on one end of the body and in which a cam radius having a predetermined shape is formed;

a guide portion, which is provided on the other end of the body and is bent at a predetermined angle;

a support portion, which is provided on a side opposite to a surface in which the guide portion is formed while protruding from the body; and an elastic unit which supports the head gap adjusting apparatus, one end of the elastic unit being supported by the carriage and the other end thereof being supported by the support portion.

2. An ink-jet printer comprising:

a carriage, which is rotatably installed on a guide shaft and includes a stacking portion on which an ink cartridge is stacked, and a balancing portion installed on a side opposite to the stacking portion, so as to move in a straight reciprocating motion along the guide shaft; and a head gap adjusting apparatus, which is rotatably installed in the balancing portion and adjusts a head gap by rotating the carriage centering on the guide shaft according to a thickness of a printing medium;

wherein the head gap adjusting apparatus comprises:

a body;

a cam portion, which is provided on one end of the body;

a guide portion, which is provided on the other end of the body and is bent at a predetermined angle; and a support portion, which is provided on a side opposite to a surface in which the guide portion is formed while protruding from the body;

wherein the cam portion includes a first cam radius formed on a surface opposite to the guide portion and a second cam radius formed on a surface perpendicular to the first cam radius.

3. The ink-jet printer of claim 2, wherein a curvature radius of the second cam radius is larger than that of the first cam radius.

4. An ink-jet printer comprising:

a carriage, which is rotatably installed on a guide shaft and includes a stacking portion on which an ink cartridge is stacked, and a balancing portion installed on a side opposite to the stacking portion, so as to move in a straight reciprocating motion along the guide shaft; and a head gap adjusting apparatus, which is rotatably installed in the balancing portion and adjusts a head gap by rotating the carriage centering on the guide shaft according to a thickness of a printing medium;

wherein the head gap adjusting apparatus comprises:

a body;

a cam portion, which is provided on one end of the body and in which a cam radius having a predetermined shape is formed;

a guide portion, which is provided on the other end of the body and is bent at a predetermined angle;

a support portion, which is provided on a side opposite to a surface in which the guide portion is formed while protruding from the body; and wherein both ends of the guide shaft are supported by a bracket, and a bent portion, which is bent to a predetermined height, is provided on one end of the bracket, and first and second stoppers are provided at a predetermined interval on a top surface of the bent portion, so as to contact the guide portion of the head gap adjusting apparatus.

5. The ink-jet printer of claim 4, wherein the first stopper protrudes vertically from the top surface of the bent portion.

6. The ink-jet printer of claim 5, wherein a printing section is located between the first and second stoppers.

7. The ink-jet printer of claim 4, wherein the second stopper protrudes in a closed trace shape from the top surface of the bent portion.

8. The ink-jet printer of claim 7, wherein a printing section is located between the first and second stoppers.

9. The ink-jet printer of claim 4, wherein a height of the second stopper is lower than that of the first stopper and is less than a height of the space portion.

10. An ink-jet printer comprising:

a carriage, which is rotatably installed on a guide shaft and includes a stacking portion on which an ink cartridge is stacked, and a balancing portion installed on a side opposite to the stacking portion, so as to move in a straight reciprocating motion along the guide shaft;

a head gap adjusting apparatus, which is rotatably installed in the balancing portion and adjusts a head gap by rotating the carriage centering on the guide shaft according to a thickness of a printing medium; and a bracket, which supports both ends of the guide shaft and on which a plurality of stoppers are provided so as to rotate the head gap adjusting apparatus while contacting the head gap adjusting apparatus;

wherein a bent portion, which is bent to a predetermined height, is provided on one end of the bracket, and the stoppers include a first stopper protruding vertically from the top surface of the bent portion, and a second stopper protruding in a closed trace shape from the top surface of the bent portion.

11. The ink-jet printer of claim 10, wherein a printing section is located between the first and second stoppers.

12. The ink-jet printer of claim 10, wherein the head gap adjusting apparatus comprises:

a body;

a cam portion, which is provided on one end of the body and in which a cam radius having a predetermined shape is formed;

a guide portion, which is provided on the other end of the body and is bent at a predetermined angle; and a support portion, which is provided on a side opposite to a surface in which the guide portion is formed while protruding from the body.

13. The ink-jet printer of claim 12, wherein a space portion having a predetermined height is formed between the cam portion and the guide portion.

14. An ink-jet printer comprising:

a carriage, which is rotatably installed on a guide shaft and includes a stacking portion on which an ink cartridge is stacked, and a balancing portion installed on a side opposite to the stacking portion, so as to move in a straight reciprocating motion along the guide shaft;

a head gap adjusting apparatus, which is rotatably installed in the balancing portion and adjusts a head gap by rotating the carriage centering on the guide shaft according to a thickness of a printing medium; and a bracket, which supports both ends of the guide shaft and on which a plurality of stoppers are provided so as to rotate the head gap adjusting apparatus while contacting the head gap adjusting apparatus;

wherein the head gap adjusting apparatus comprises:

a body;

a cam portion, which is provided on one end of the body and in which a cam radius having a predetermined shape is formed;

a guide portion, which is provided on the other end of the body and is bent at a predetermined angle;

a support portion, which is provided on a side opposite to a surface in which the guide portion is formed while protruding from the body; and an elastic unit which supports the head gap adjusting apparatus, one end of the elastic unit being supported by the carriage and the other end thereof being supported by the support portion.

15. An ink-jet printer comprising:

a carriage, which is rotatably installed on a guide shaft and includes a stacking portion on which an ink cartridge is stacked, and a balancing portion installed on a side opposite to the stacking portion, so as to move in a straight reciprocating motion along the guide shaft;

a head gap adjusting apparatus, which is rotatably installed in the balancing portion and adjusts a head gap by rotating the carriage centering on the guide shaft according to a thickness of a printing medium; and a bracket, which supports both ends of the guide shaft and on which a plurality of stoppers are provided so as to rotate the head gap adjusting apparatus while contacting the head gap adjusting apparatus;

wherein the head gap adjusting apparatus comprises:

a body;

a cam portion, which is provided on one end of the body;

a guide portion, which is provided on the other end of the body and is bent at a predetermined angle; and a support portion, which is provided on a side opposite to a surface in which the guide portion is formed while protruding from the body; and wherein the cam portion includes a first cam radius formed on a surface opposite to the guide portion and a second cam radius formed on a surface perpendicular to the first cam radius.

16. The ink-jet printer of claim 15, wherein a curvature radius of the second cam radius is larger than that of the first cam radius.

* * * * *